United States Patent [19]

Bonfiglioli et al.

[11] Patent Number: 4,886,025

[45] Date of Patent: Dec. 12, 1989

[54] IDLING SPEED CONTROL SYSTEM FOR AN ELECTRONIC-INJECTION INTERNAL COMBUSTION ENGINE

[75] Inventors: Silverio Bonfiglioli, Zola Predosa; Gianni Fargnoli, Anzola Emilia; Massimo Fato, Modena, all of Italy

[73] Assignee: Weber S.r.l., Turin, Italy

[21] Appl. No.: 156,840

[22] Filed: Feb. 17, 1988

[30] Foreign Application Priority Data

Feb. 17, 1987 [IT] Italy ..... 67105 A/87

[51] Int. Cl.[4] ..... F02D 33/02; F02M 3/07

[52] U.S. Cl. ..... 123/339; 123/340

[58] Field of Search ..... 123/339, 340

[56] References Cited

U.S. PATENT DOCUMENTS

| | | | |
|---|---|---|---|
| 1,754,028 | 4/1930 | Martin | 123/340 |
| 2,841,130 | 7/1958 | Reggio | 123/340 |
| 2,906,253 | 9/1959 | Nallinger | 123/339 |
| 3,577,978 | 5/1971 | Garcea | 123/340 |
| 4,099,506 | 7/1978 | Kolb | 123/339 |
| 4,291,656 | 9/1981 | Miyagi | 123/339 |
| 4,365,599 | 12/1982 | Ikeura | 123/340 |
| 4,465,043 | 8/1984 | Denz | 123/339 |
| 4,474,151 | 10/1984 | Atago | 123/340 |
| 4,580,536 | 4/1986 | Takao | 123/339 |
| 4,750,598 | 6/1988 | Danno | 123/340 |

FOREIGN PATENT DOCUMENTS

| | | | |
|---|---|---|---|
| 0131337 | 8/1983 | Japan | 123/339 |

*Primary Examiner*—Carl S. Miller

*Attorney, Agent, or Firm*—Gifford, Groh, Sheridan, Sprinkle and Dolgorukov

[57] ABSTRACT

A system for controlling the idling speed of an electronic-injection internal combustion engine; which engine presents an air supply valve, the minimum setting of which is controlled by at least one heat-sensitive element; and which system comprises electronic means for detecting at least the speed of the engine, the temperature of the engine cooling water, and release of the accelerator pedal, for accordingly regulating the amount of heat supplied to the aforementioned heat-sensitive element.

15 Claims, 4 Drawing Sheets

IDLING SPEED CONTROL SYSTEM FOR AN ELECTRONIC-INJECTION INTERNAL COMBUSTION ENGINE

BACKGROUND OF THE INVENTION

The present invention relates to an idling speed control system for an internal combustion engine featuring an electronic fuel injection system, preferably, but not exclusively, of the single injection type. The said system provides for controlling idling speed both during and subsequent to warming up the engine, that is, whenever minimum engine speed falls, for example, due to connection of additional loads such as the air conditioner, or as a result of varying external parameters, such as gradients.

Idling of an internal combustion engine, mainly when starting and warming up the engine, is conveniently controlled by a heat-sensitive element which, when subjected to the gradually increasing temperature of the engine cooling water, gradually pushes out a piston and, via a number of lever systems, gradually reduces the minimum aperture of a throttle valve controlling air supply to the engine. A major drawback of control systems of the aforementioned type is that response time for reducing the minimum aperture of the said main throttle valve is relatively slow, with the result that the engine is maintained at a higher than theoretically optimum idling speed. The poor precision and relatively slow response of known control systems of the aforementioned type are particularly disadvantageous when applied to electronic injection systems, which, on the contrary, are programmed for ensuring greater control efficiency of the engine under all operating conditions. Idling speed control systems have been proposed for overcoming the aforementioned drawbacks, but these are invariably highly sophisticated and, therefore, expensive.

SUMMARY OF THE INVENTION

The aim of the present invention is to provide an idling speed control system for an internal combustion engine featuring an electronic injection system, which control system provides for rapid response and a high degree of efficiency and accuracy, while at the same time being relatively cheap to manufacture and, therefore, suitable for fitness to relatively straightforward, low-cost electronic injection systems.

With this aim in view, according to the present invention, there is provided a system for controlling the idling speed of an internal combustion engine featuring an electronic injection system, said engine presenting an air supply valve, the minimum setting of which is controlled by at least a heat-sensitive element; characterized by the fact that it comprises electronic means for detecting at least the speed of the said engine, the temperature of the engine cooling water, and release of the accelerator pedal, for accordingly regulating the amount of heat supplied to the said heat-sensitive element.

BRIEF DESCRIPTION OF THE DRAWINGS

A non-limiting embodiment of the present invention will be described by way of example with reference to the accompanying drawings, in which.

DETAILED DESCRIPTION OF THE INVENTION

Figure 1:
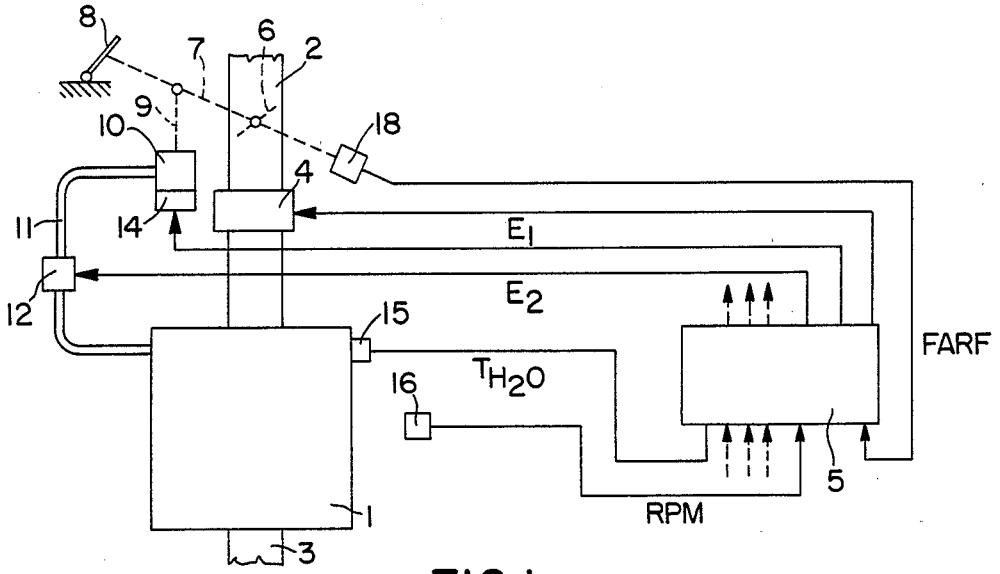
FIG. 1 shows a schematic view of the control system according to the present invention and applied to an internal combustion engine.

Number 1 in FIG. 1 indicates an internal combustion engine having an intake pipe 2 and exhaust pipe 3; the said intake pipe 2 housing an electronic injection unit 4, conveniently a single-injection type, controlled by an electronic control system 5 conveniently featuring a microprocessor. Intake pipe 2 houses a main throttle valve 6 having a rotary shaft 7 and the setting of which is controlled mechanically by a pedal-operated accelerator 8. As discussed in more detail with reference to FIG. 2, the minimum rotation setting of the said shaft 7 is also controlled mechanically by a piston 9 of a heat-sensitive element 10 conveniently containing a wax mixture and in thermal contact with a pipe 11 for recirculating the cooling water from engine 1. The said pipe 11 houses an electrovalve 12 controlled by a signal $E_2$ from control system 5, which also supplies a further signal $E_1$ to an electrical heating element 14 thermally connected directly to heat-sensitive element 10. The said control system 5 also receives a $TH_2O$ signal indicating the engine cooling water temperature and supplied by a sensor 15 on engine 1; an RPM signal indicating the speed of engine 1 and supplied by a sensor 16; and a FARF signal indicating the setting of throttle valve 6 and supplied by a potentiometer 18 connected in known manner to shaft 7. Electronic control system 5 also presents further input and output signals for the said electronic injection system, which signals are known and, therefore, require no explanation. Number 20 in FIGS. 2 and 3 indicates a throttle body housed inside intake pipe 2 and fitted transversely with shaft 7 to which throttle valve 6 is secured angularly. The said throttle body 20 presents an inner pipe 21 (shown partially in FIG. 3) connected by an external tube 22 (FIG. 2) to cooling water recirculating pipe 11. From one side of the said throttle body 20, there extends outward, in integral and thermally-conductive manner, a hollow, cylindrical, internally-threaded portion 23 into which is screwed the top portion of the bulb on heat-sensitive element 10, the bottom of which is connected, e.g. bonded, in thermally-contacting manner to electrical heating element 14, conveniently a PTC. The end of piston 9 is secured to the end 25 of a level 26, which is secured by pin 27 to throttle body 20 and presents another end 28 having a cam profile 29 cooperating with a roller 30 carried on one end of lever 31 secured angularly to shaft 7. The end of piston 9 and end 25 of lever 26 are so connected as to enable rotation of end 25 subsequent to linear displacement of piston 9, e.g. by means of a slot 32 housing an appendix 33 carried on the end of piston 9. Lever 26 is pushed against piston 9 by a spring 34 wound about pin 27 and secured between lever 26 and a pin 35 projecting from throttle body 20. Shaft 7 is angularly connected to a shaft controlling potentiometer 18, which is fitted to a bracket 38, in turn, secured by screws 39 to throttle body 20.

The control system according to the present invention briefly operates as follows. The straight line marked "a" in FIG. 5*a* indicates the nominal speed (RPMN) the engine should theoretically preent at various cooling water temperatures ($TH_2O$): the said line "a" slopes down alongside increasing temperature, in that, correctly speaking, the idling speed of the engine should decrease alongside increasing temperature of the engine and, therefore, the cooling water, as far as 80° C., at which point idling speed is expected to remain steady at 850 rpm. On the control system according to the present invention, theoretical idling speed line "a" has been replaced by line "b", which also terminates at 850° rpm at 80° C., but which presents a steeper slope, so as to determine a safety threshold speed (RPMS). The actual engine speed (RPM) at various cooling water temperatures is shown by curve "d", which, by virtue of the control system according to the present invention, oscillates about line "b". In fact, when the actual speed RPM of engine 1 exceeds the corresponding speed RPMS on line "b" at a given temperature A, control system 5 first checks that electrovalve 12 is open for supplying heat to heat-sensitive element 10 via cooling water pipe 11, and then provides for supplying additional heat to heat-sensitive element 10 by electrically supplying electric heating element 14. Such electrical supply, determined by signal $E_1$ (FIG. 5*b*), is delayed by time TA and continued for time $TE_1$ which depends on the detected cooling water temperature and the difference between actual speed RPM and the theoretical speed of line "a". $E_1$ is therefore expressed by the following equation:

$$E_1 = F(TH_2O) + (\Delta RPM \times K_1 + K_2).$$

Figure 6A:
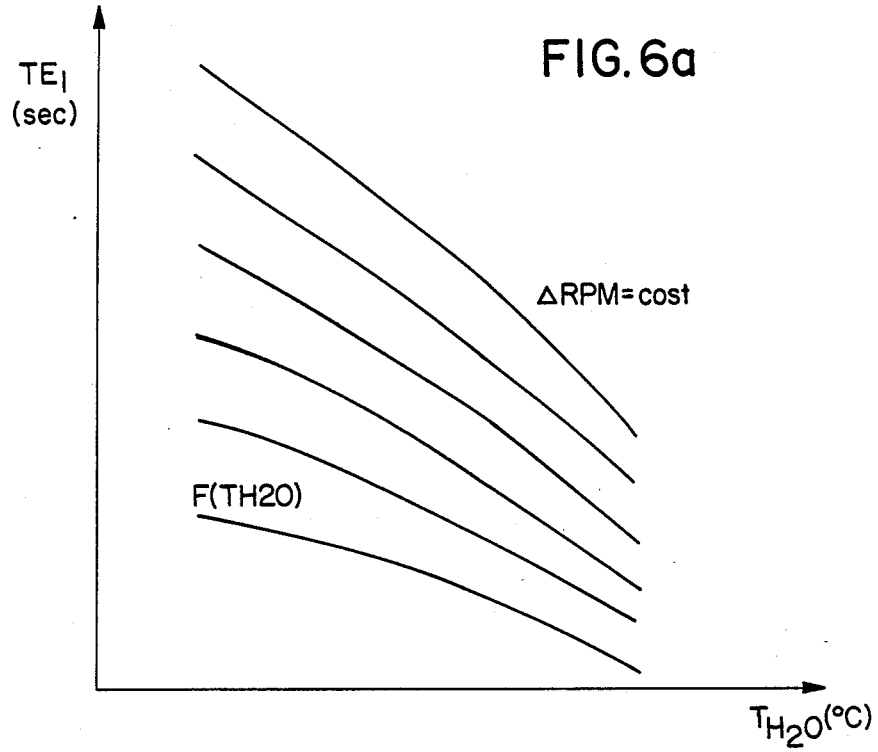
FIGS. 6*a* and 6*b* show graphs of a number of parameters employed in the FIG. 4 blocks.
Figure 6B:
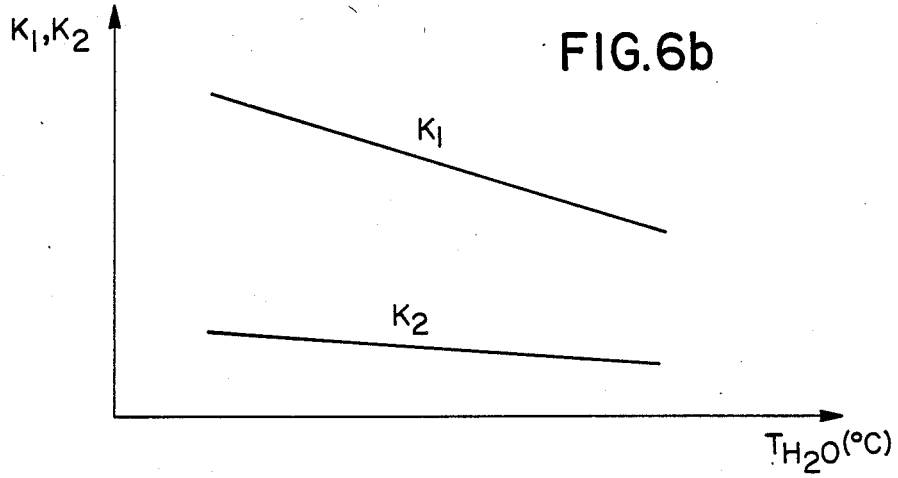

As shown in FIG. 6*a*, time $TE_1$ therefore decreases alongside increasing cooling water temperature, as do also parameters $K_1$ and $K_2$ in FIG. 6*b*.

Figure 2:
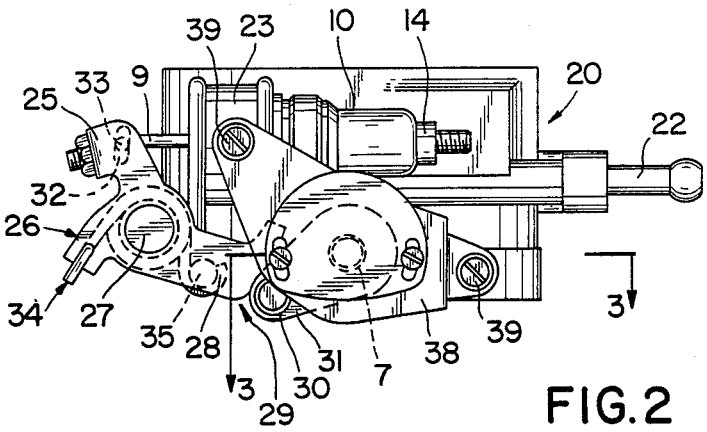
FIG. 2 shows a side view of a throttle body for supplying the internal combustion engine and featuring a number of components on the FIG. 1 control system.
Figure 3:
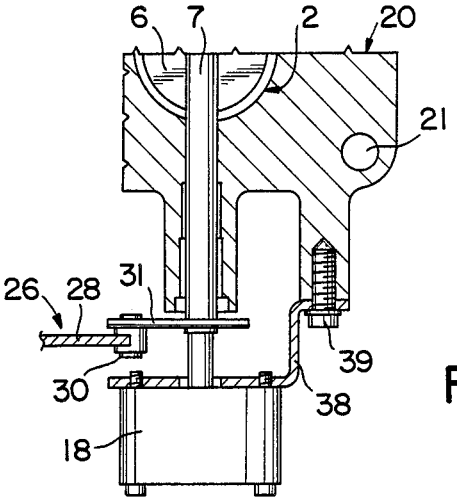
FIG. 3 shows a partial section along line III—III in FIG. 2.

During the period in which signal $E_1$ is supplied by control system 5, the heat supplied to heat-sensitive element 10 moves out piston 9 and, as shown in FIG. 2, gradually turns lever 26 anticlockwise and lever 31 clockwise, so as to gradually close throttle valve 6 and reduce the RPM speed of engine 1 as shown by line "b". When, at temperature B, engine speed again exceeds the RPMS value on line "b", signal $E_1$ is again supplied with delay TA and for duration $TE_1$ which, in this case, is shorter, as shown in FIG. 6*a*. The same control cycle is repeated at temperature C, and so on up to a cooling water temperature of 80° C. From this point on, control of electrical heating element 14 by signal $E_1$ is cut off, so that the position of piston 9 is determined solely by the amount of heat supplied by the engine cooling water, and throttle valve 6 is almost completely closed (conveniently by means of a limit stop). If, at a cooling water temperature of 80° C., idling speed drops to below 850 rpm, e.g. 750 rpm, due to the connection of additional loads or varying gradients, for example, the control system according to the present invention detects the said fall in speed, and closes electrovalve 12 to prevent heat-sensitive element 10 from being heated by the engine cooling water. This causes piston 9 to withdraw inside the bulb on element 10, and opens throttle valve 6 so as to bring engine speed back up to 850 rpm.

Figure 5A:
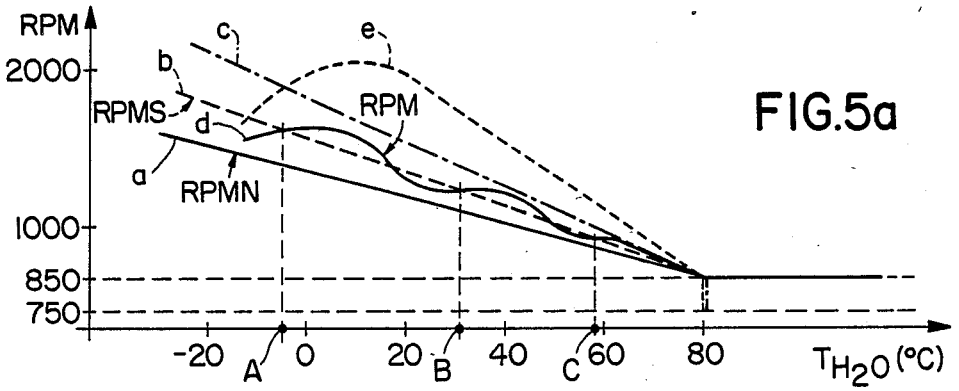
FIGS. 5*a* and 5*b* show graphs of a number of parameters and quantities relative to the FIG. 1 control system.
Figure 5B:
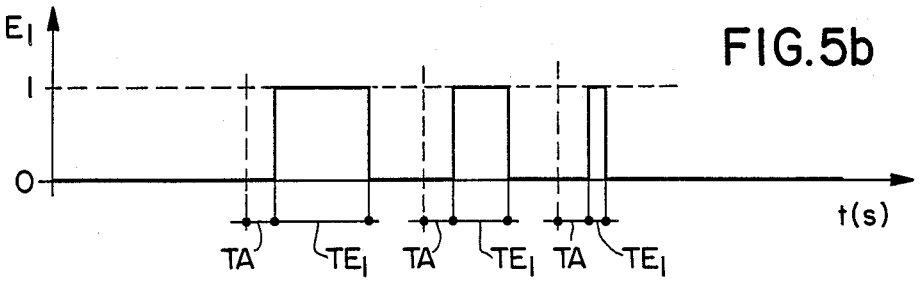
Figure 4:
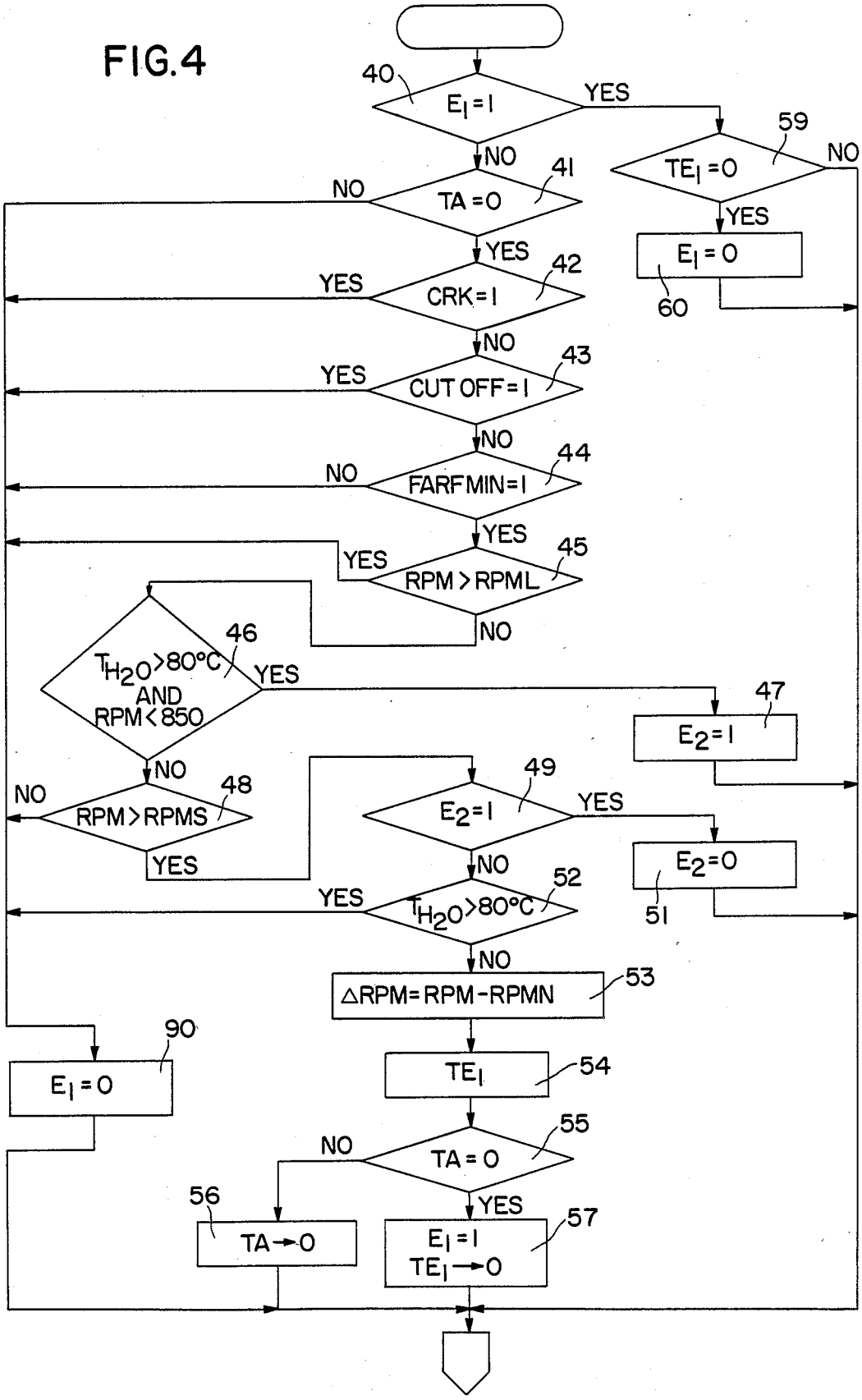
FIG. 4 shows an operating block diagram of part of the control system on the FIG. 1 system.

The above operation of the control system according to the present invention will now be detailed further with reference to FIG. 4, which shows the operating cycle performed by electronic control system 5. The said cycle, which is repeated periodically by system 5, commences with block 40, which determines whether signal $E_1=1$, that is, whether heating element 14 is being supplied electrically, thus indicating interval $TE_1$ in FIG. 5*b*. In the event of a negative response, block 40 goes on to block 41, which determines whether delay time TA=0, that is, has expired. In the event of a negative response, the program is abandoned via block 90, which certifies $E_1=0$, that is, that electrical supply has been cut off the element 14. In the event of a positive response, however, block 41 goes on to block 42, which determines whether the engine start-up supply program controlled by system 5 is still being performed, as indicated by a CRK signal value 1. In the event of a positive response in block 42, the program is abandoned, in that the present idling speed control system is not called upon to operate during start-up. In the event of a negative response, however, indicating start-up has been completed, block 42 goes on to block 43, which determines whether system 5 is in the so-called "cut-off" stage wherein, despite accelerator pedal 8 being released, engine speed exceeds a given preset value, e.g. 1500 rpm. During this stage, which is indicated by a CUT-OFF=1 signal, fuel supply to the injector is cut off. In the event of a positive response in block 43, the program is abandoned in that the idling control system according to the present invention is not called upon to operate. In the even of a negative response, however, block 43 goes on to block 44, which determines whether the accelerator is released, i.e. whether the FARF MIN signal, corresponding to a minimum FARF signal from potentiometer 18, equals 1. In the event of a negative response, i.e. accelerator 8 not released, the program is abandoned in that the present idling control system is not called upon to operate. In the event of a positive response, however, block 44 goes on to block 45, which determines whether engine speed (RPM) exceeds a given, relatively high minimum value (RPML) corresponding to line "c" in FIG. 5*b* and determined, for example, by an engine brake condition, as when traveling downhill. In the event of a positive response, the program is abandoned in that the present control system is not called upon to operate. In the event of a negative response, however, block 45 goes on to block 46, which determines the existence of the conditions, already described in connection with FIG. 5*a*, for cutting off cooling water supply via pipe 11, should the minimum speed of the engine fall below 750 rpm at 80° C., due, for example, to the connection of additional loads or varying gradients. Block 46 therefore determines whether the cooling water temperature is over 80° C. and actual engine speed below 850 rpm. In the event of a positive response, block 46 goes on to block 47, which sets signal $E_2$ to 1, thus closing electrovalve 12 and cutting off the cooling water in pipe 11, after which, the program is abandoned. In the event of a negative response, however, i.e. no recovery in engine speed required, block 46 goes on to block 48, which determines whether actual engine speed (RPM) is higher than the corresponding speed on line "b" (RPMS) relative to the same temperature (the said RMS and RPMN values on lines "b" and "a" in FIG. 5*a* are stored as discreet values in ROM memories on system 5, the intermediate values conveniently being obtained by interpolation). In the event of a negative response in block 48, the program is abandoned, in that the present control system is not called upon to operate. In the event of a positive response, however, i.e. engine speed in excess of the threshold, block 48 goes on to block 49, which determines whether $E_2=1$, i.e. whether cooling water supply in pipe 11 has beencut off by electrovalve 12. In the event of a positive response, block 49 goes on to block 51, which sets $E_2$ to 0, thus opening electrovalve 12, after which, the program is abandoned. In the event of a negative response, however, block 49 goes on to block 52, which determines whether the cooling water temperature $TH_2O$ is over 80° C. In the event of a positive response, the program is abandoned, in that the present control system is not called upon to operate. In the event of a negative response, however, block 52 goes on to block 53, which calculates the ΔRPM value by subtracting theoretical engine speed (RPMN) from actual engine speed (RPM) at the same temperature. Block 53 goes on to block 54, which calculates the length of time $TE_1$ that signal $E_1$ is supplied to electrical heating element 14; said interval $TE_1$ being calculated according to the equation already seen in connection with FIG. *6a*. Block 54 then goes on to block 55, which determines whether delay time TA has expired. In the event of a negative response, block 55 goes on to block 56, which counts down the said delay time TA. In the event of a positive response, however, block 55 goes on to block 57, which enables signal $E_1$ for supplying electrical heating element 14, and, at the same time, counts down interval $TE_1$. The program is abandoned subsequent to both block 56 and block 57.

In the event of a positive response in block 40, i.e. signal $E_1$ being supplied to electrical heating element 14, block 40 goes on to block 59, which determines whether supply time $TE_1$ has expired. In the event of a negative response, the program is abandoned, whereas, in the event of a positive response, block 59 goes on to block 60, which sets $E_1$ to 0, thus cutting off electrical supply to element 14, after which, the program is abandoned. The advantages of the control system according to the present invention will be clear from the foregoing description. Firstly, while being relatively straightforward and low-cost, the said system provides for loop control, with relatively fast response times, of idling speed during warm-up of the engine, which speed is maintained fairly close to theoretical values, as a function of the gradual increase in temperature of the engine. Such control is based simply on the heat supplied by the cooling water to the heat-sensitive element controlling the minimum setting of the throttle valve, as well as on additional heat supplied by an electrical heating element, conveniently a self-regulating PTC; which electrical supply is regulated as a function of the current cooling water temperature and the difference between actual and theoretical engine speed. Curve "e" in FIG. *5a* shows engine speed as a function of increasing cooling water temperature, as determined solely by cam profile 29 of lever 26, and with open-loop control determined solely by the amount of heat supplied to heat-sensitive element 10 by the engine cooling water. The advantage of the control system according to the present invention is clearly shown by the closeness of actual and theoretical speed lines "b" and "a". To those skilled in the art it will be clear that changes may be made to the embodiment of the control system described and illustrated herein without, however, departing from the scope of the present invention. For example, cooling water may be supplied, via appropriate piping, in such a manner as to contact heat-sensitive element 10 directly; changes may be made to several of the operating blocks in FIG. 4; and the electronic injection system may be modified to produce various configurations as required.

We claim:

1. A system for controlling the idling speed of an internal combustion engine (1) featuring an electronic injection system, said engine (1) presenting an air supply valve (6), the minimum setting of which is controlled by at least a heat-sensitive element (10); characterized by the fact that it comprises electronic means (5) for detecting at least the speed of the said engine (1), the temperature of engine cooling water, and release of the accelerator pedal (8), for accordingly regulating the amount of heat supplied to the said heat-sensitive element (10) by said electronic means regulating at least one of the flow of cooling water and the amount of heat supplied by electrical means to said heat-sensitive element.

2. A system as claimed in claim 1, characterized by the fact that said electronic means (5) are designed to regulate amount of heat supplied by said cooling water to said heat-sensitive element (10), and the amount of heat supplied by electrical means to the said heat-sensitive element (10).

3. A system as claimed in claim 2, characterized by the fact that said electronic means (5) control flow, inside a pipe (11), of said cooling water towards a zone (22) conducting thermally with said heat-sensitive element (10).

4. A system as claimed in claim 3, characterized by the fact that said electronic means (5) control an electrovalve (12) in said pipe (11).

5. A system as claimed in claim 2, characterized by the fact that said electronic means (5) control electrical supply to resistor means (14) conducting thermally with the said heat-sensitive element (10).

6. A system as claimed in claim 5, characterized by the fact that said resistor means comprise a PTC (14).

7. A system as claimed in claim 1, characterized by the fact that said heat-sensitive element (10) comprises a bulb sensor and a piston (9); said piston being designed to position said valve (6) by means of at least a pair of interacting elements (26, 31); at least one (26) of said elements having an activating cam profile (29).

8. A system as claimed in claim 1, characterized by the fact that claim 1, said electronic means form part of an electronic microprocessor system (5) controlling the said electronic injection.

9. A system as claimed in claim 8, characterized by the fact that said electronic means comprise means (42, 43, 44) for enabling the said adjustment in amount of heat supplied to said heat-sensitive element (10); said enabling means, in addition to determining release of the accelerator pedal, also determining completion of the engine start-up phase and non-existence of a "cut-off" condition wherein the accelerator pedal is released and engine speed is in excess of a first given value.

10. A system as claimed in claim 9, characterized by the fact that said enabling means (42, 43, 44, 45) also determine non-existence of an engine brake condition wherein the accelerator pedal (8) is released and engine speed (RPM) is below a second given value (RPML) lower than said first value.

11. A system as claimed in claim 8, characterized by the fact that said electronic means (5) comprise first means (46) for determining whether temperature of the said cooling water is in excess of a first given value and whether, at the same time, engine speed (RPM) is below a given minimum value, so as to accordingly cut off heat supply to the said heat-sensitive element (10) and increase the speed of the engine (1).

12. A system as claimed in claim 8, characterized by the fact that said electronic means (5) comprise second means (48) for determining whether engine speed (RPM) is over a given threshold of the speed (RPMS) depending on the cooling water temperature, so as to accordingly supply heat to said heat-sensitive element (10) and reduce the speed of said engine (1).

13. A system as claimed in claim 12, characterized by the fact that said second means comprise means (51) for first supplying heat from said cooling water to the said heat-sensitive element (10), and means (52) for determining whether the temperature of said cooling water is below a given value, for accordingly supplying heat from electrical means (14) to said heat-sensitive element (10).

14. A system as claimed in claim 13, characterized by the fact that said second means comprise means (54) for calculating amount of heat supplied by the said electrical means (14), at least as a functio of the temperature of said cooling water and the difference between actual engine speed (RPM) and theoretical engine speed (RPMN) depending on the temperature of said cooling water.

15. A system as claimed in claim 14, characterized by the fact that said electronic means (5) enable supply of said amount of heat by said electrical means (14) subsequent to a given delay time (TA) commencing from when said given speed threshold (RPMS) depending on the cooling water temperature is found to have been exceeded.

* * * * *